US006032598A

United States Patent [19]

Yu

[11] Patent Number: 6,032,598

[45] Date of Patent: Mar. 7, 2000

[54] SCISSORS-TYPE THREAD-CUTTING DEVICE FOR A SEWING MACHINE

[76] Inventor: Ming-Tung Yu, No. 4, Hsiu-Wu St., San-Min Dist., Kaohsiung City, Taiwan

[21] Appl. No.: 09/184,550

[22] Filed: Nov. 2, 1998

[51] Int. Cl.[7] ..... D05B 65/00

[52] U.S. Cl. ..... 112/294

[58] Field of Search ..... 112/285, 286, 112/288, 291, 293, 294, 295, 297, 300; 30/277.4, DIG. 8; 83/907, 910, 699.51

[56] References Cited

U.S. PATENT DOCUMENTS

| | | | |
|---|---|---|---|
| 2,301,798 | 11/1942 | Spaine | 112/294 |
| 2,572,143 | 10/1951 | Hazelton | 112/293 |
| 3,440,985 | 4/1969 | Kozuka | 112/294 |
| 3,747,748 | 7/1973 | Brophy et al. | 112/293 |
| 4,683,828 | 8/1987 | Matsumoto | 112/294 |
| 5,178,084 | 1/1993 | Rohr | 112/294 X |

*Primary Examiner*—Ismael Izaguirre
*Attorney, Agent, or Firm*—Ladas & Parry

[57] ABSTRACT

A scissors-type thread-cutting device for a sewing machine includes an elongated base, which is adapted to be fixed on the machine bed. An elongated first blade member is mounted telescopically on and locked releasably on the base, and is movable lengthwise on the same when released. A sliding member can move lengthwise on the first blade member. A driving unit is adapted to be disposed on the machine bed for activating the sliding member to reciprocate on the first blade member. An elongated second blade member is mounted telescopically on and locked releasably on the sliding member, and presses against the first blade member. The first and second blade members have intersecting cutting edges, which are adapted to cut a thread therebetween during movement of the second blade member relative to the first blade member.

4 Claims, 5 Drawing Sheets

SCISSORS-TYPE THREAD-CUTTING DEVICE FOR A SEWING MACHINE

BACKGROUND OF THE INVENTION

1. Field of the Invention

This invention relates to a sewing machine, more particularly to a scissors-type thread-cutting device for a sewing machine, which includes a first blade member and a second blade member that presses against the first blade member and that is movable relative to the first blade member to cut a thread therebetween.

2. Description of the Related Art

Referring to FIGS. 1 and 2, a conventional scissors-type thread-cutting device for a sewing machine is shown to include a base 21 adapted to be fixed on a machine bed 1, a first blade member 22 locked on the base 21 by means of a lock bolt 221, and a movable cutting unit 23. The movable cutting unit 23 includes a sliding member 231 which can be activated by a driving unit 11 to reciprocate on the machine bed 1, and a second blade member 232 which is carried on the sliding member 231 to move relative to the first blade member 22. The aforesaid conventional device suffers from the following disadvantages:

(1) When wearing occurs between the blade members 22, 232, only the angular position of the first blade member 22 can be adjusted. This adjustment does not permit close contact between the blade portions of the blade members 22, 232 to an extent that enables the blade members 22, 232 to perform a cutting action effectively. In this case, the worn blade members 22, 232 must be replaced with new ones.

(2) It is time-consuming to adjust the blade members 22, 232 to achieve close contact therebetween.

(3) The aforesaid conventional device cannot be used on different types of sewing machines due to the fixed angle between the base 21 and the blade members 22, 232.

SUMMARY OF THE INVENTION

One object of this invention is to provide a sewing machine with a scissors-type thread-cutting device, which includes two blade members that can be easily adjusted to contact each other closely.

Another object of this invention is to provide a scissors-type thread-cutting device, which can be used on different types of sewing machines.

According to this invention, a scissors-type thread-cutting device for a sewing machine includes an elongated base adapted to be fixed on a machine bed. An elongated first blade member is mounted telescopically and is locked releasably on the base. When released from the base, the first blade member can move lengthwise on the same. A sliding member can move lengthwise on the first blade member. A driving unit is adapted to be disposed on the machine bed for activating the sliding member to reciprocate on the first blade member. An elongated second blade member is mounted telescopically and locked releasably on the sliding member, and presses against the first blade member. The first and second blade members have intersecting cutting edges, which are adapted to cut a thread therebetween during movement of the second blade member relative to the first blade member.

Preferably, there is provided means for positioning the base on the machine bed, which includes a vertical lower positioning plate that has a straight lower slide slot formed therethough. A horizontal base connecting plate extends integrally and perpendicularly from the vertical lower positioning plate. A lower lock bolt extends through the lower slide slot in the vertical lower positioning plate to engage the threaded hole in the base, thereby fixing the vertical lower positioning plate on the base. The lower lock bolt is capable of being loosened from the vertical lower positioning plate so as to slide in the lower slide slot in the vertical lower positioning plate, thereby varying position of the vertical lower positioning plate relative to the base. A vertical upper positioning plate is perpendicular to the vertical lower positioning plate, and has a straight upper slide slot formed therethrough. A horizontal machine-bed connecting plate extends integrally and perpendicularly from the vertical upper positioning plate, and has a straight intermediate slide slot that extends in a direction parallel to the upper slide slot in the vertical upper positioning plate. An upper lock bolt extends through the upper slide slot in the vertical upper positioning plate and is adapted to engage the threaded hole in the vertical wall of the machine bed, thereby fixing the vertical upper positioning plate on the vertical wall of machine bed. The upper lock bolt is capable of being loosened from the vertical upper positioning plate so as to slide in the upper slide slot in the vertical upper positioning plate, thereby varying position of the vertical upper positioning plate relative to the vertical wall of the machine bed. A zigzag-cross-sectioned connecting plate has two parallel plate sections. One of the plate sections is bolted to the base connecting plate. The other one of the plate sections has a threaded hole formed therein. An intermediate lock bolt extends through the intermediate slide slot in the machine-bed connecting plate to engage the threaded hole in the zigzag-cross-sectioned connecting plate. Accordingly, the orientation of the base relative to the vertical wall of the machine bed can be adjusted. As such, the thread-cutting device of this invention can be used on different types of sewing machines.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
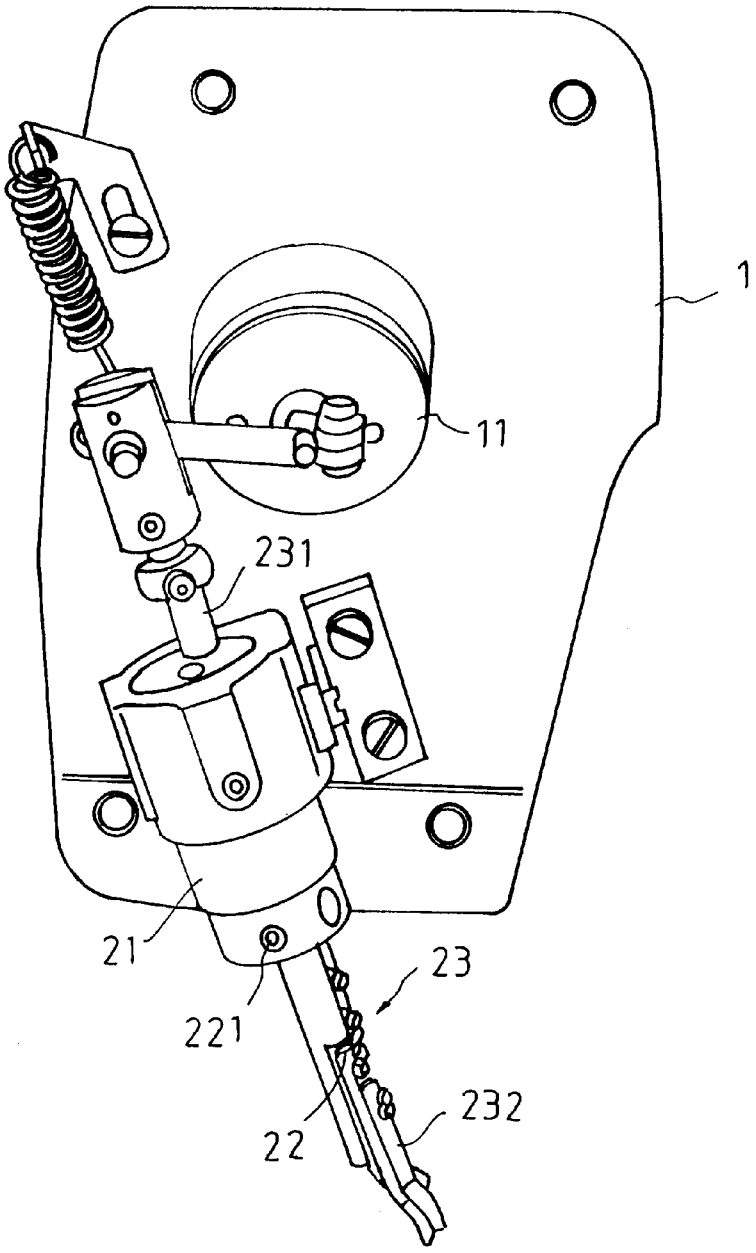
FIG 1 PRIOR ART
FIG. 1 illustrates a conventional scissors-type thread-cutting device for a sewing machine.
Figure 2:
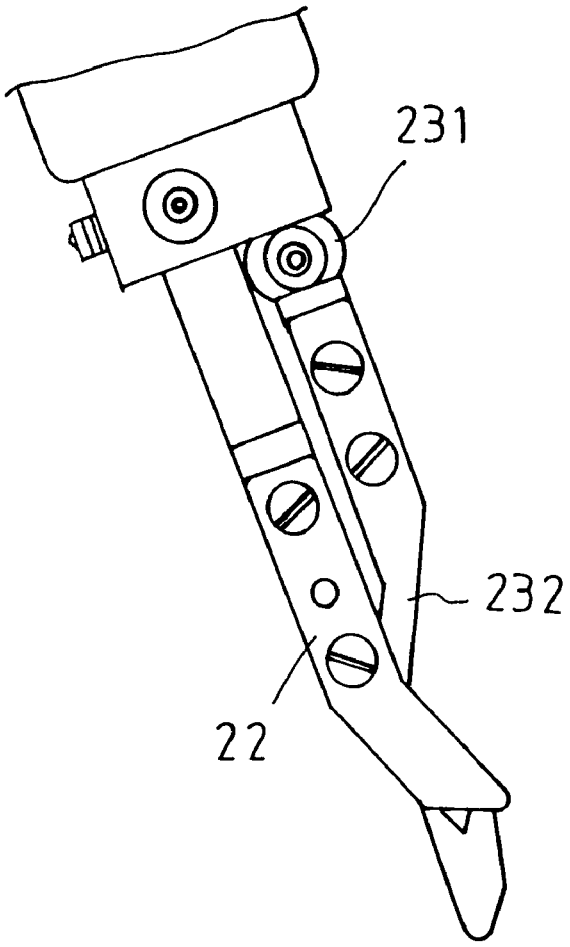
FIG. 2 PRIOR ART
FIG. 2 illustrates the position relationship between two blade members of the conventional scissors-type thread-cutting device shown in FIG. 1.
Figure 3:
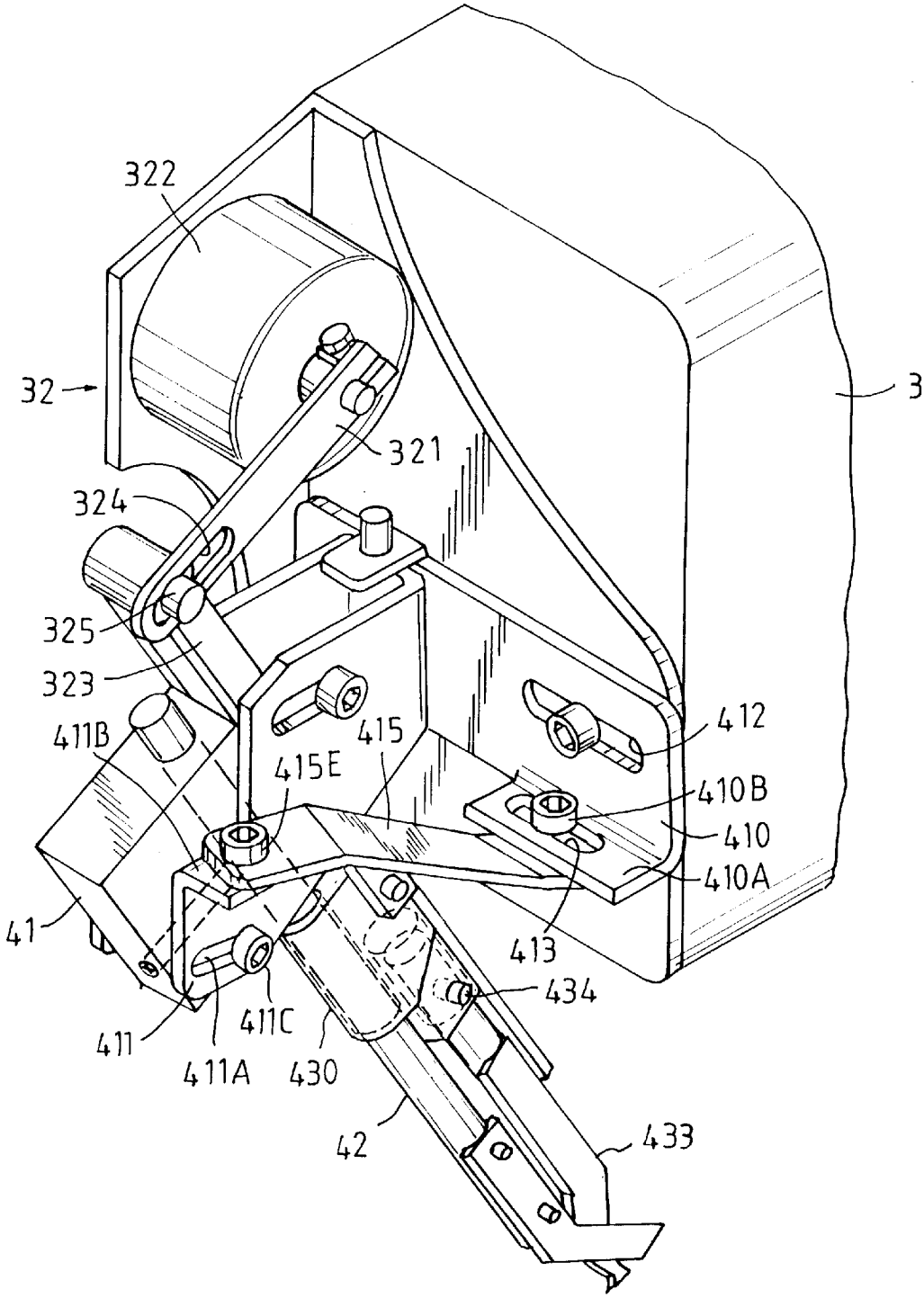
FIG. 3 is a perspective view of the preferred embodiment of a scissors-type thread-cutting device according to this invention.
Figure 5:
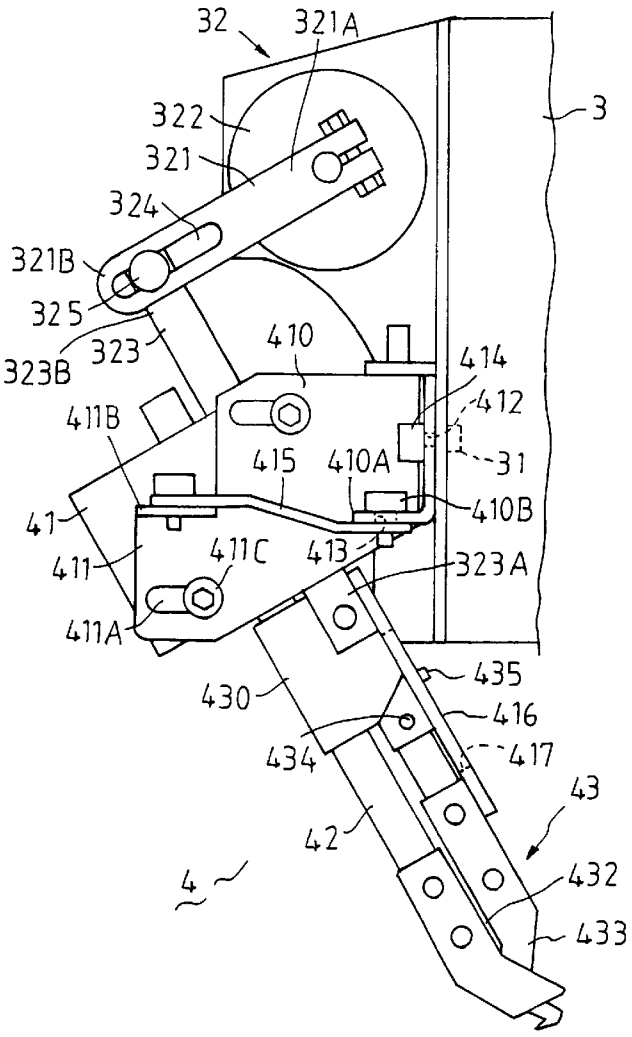
FIG. 5 is a schematic front view of the preferred embodiment.
Figure 4:
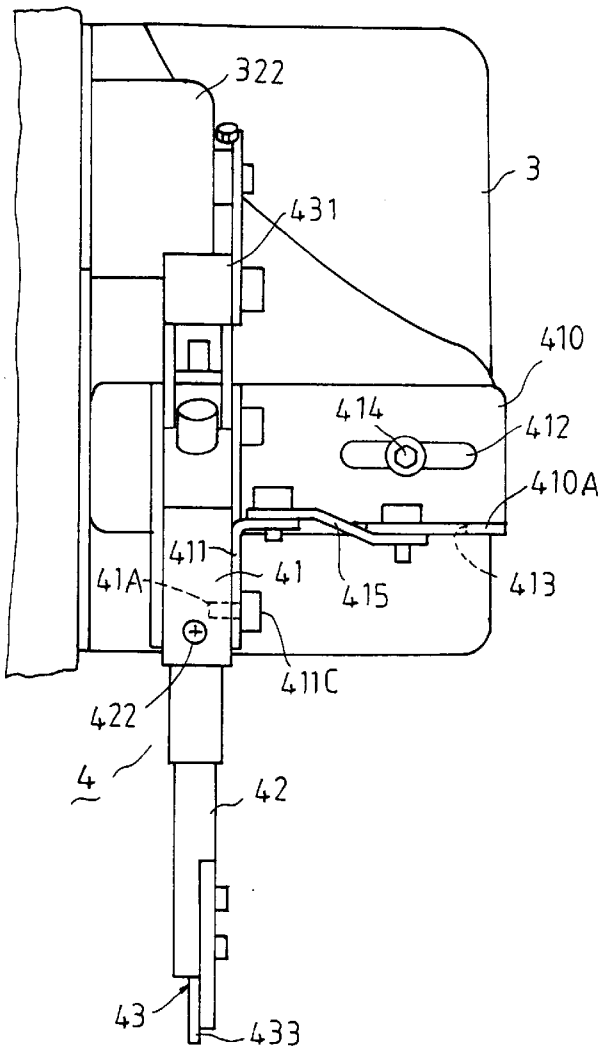
FIG. 4 is a schematic side view of the preferred embodiment.

Referring to FIGS. 3, 4 and 5, the preferred embodiment of a scissors-type thread-cutting device 4 for a sewing machine according to this invention is shown to be mounted on a vertical wall 3 of a machine bed. The device 4 includes an elongated base 41, an elongated first blade member 42, and a movable assembly 43. The movable assembly 43 includes a sliding member 430 and an elongated second blade member 433.

The base 41 is adapted to be fixed on the vertical wall 3. The first blade member 42 is mounted telescopically on the base 41, and is locked releasably on the same by a lock bolt 422. When the lock bolt 422 is loosened from the first blade member 42, the first blade member 42 is capable of moving lengthwise on the base 41 and rotating about the axis of the first blade member 42.

The sliding member 430 is mounted slidably on the first blade member 42, and can move lengthwise on the first blade member 42. A driving unit 32 includes a crank 321, a motor 322, and a coupler 323. The crank 321 has a pivot end portion 321A which is adapted to be mounted pivotally on the vertical wall 3 of the machine bed, and a connecting end portion 321B formed with a slide slot 324. The motor 322 is adapted to activate the crank 321 to swing on the vertical wall 3 of the machine bed. The coupler 323 has a first end portion 323A connected pivotally to the slide member 430, and a second end portion 323B, which is formed with a fixed pivot pin 325 that extends slidably into the slide slot 324 in the crank 321.

The second blade member 433 is mounted telescopically on the sliding member 430, and is locked releasably on the same by a lock bolt 434 in such a manner to press against the first blade member 42. When the lock bolt 434 is loosened from the second blade member 433, the second blade member 433 is capable of moving lengthwise on the sliding member 430, and rotating about the axis of the second blade member 433. The first and second blade members 42, 433 have intersecting cutting edges 42A, 433A (see FIG. 6), which are adapted to cut a thread (not shown) therebetween during relative movement of the blade members 42, 433. The thread (not shown) can be moved into a space 432 (see FIG. 5) between the blade members 42, 433, and is cut by the intersecting cutting edges 42A, 433A in a known manner.

The device 4 further has means for positioning the base 41 on the vertical wall 3 of the machine bed, which includes a vertical upper positioning plate 410, a vertical lower positioning plate 411, and a zigzag-cross-sectioned connecting plate 415. The vertical upper positioning plate 410 is perpendicular to the vertical lower positioning plate 411, and has a horizontally extending straight upper slide slot 412 formed therethrough. A horizontal machine-bed connecting plate 410A extends integrally from the vertical upper positioning plate 410, and has a straight intermediate slide slot 413 that extends in a direction parallel to the upper slide slot 412 in the vertical upper positioning plate 410. An upper lock bolt 414 extends through the upper slide slot 412 in the vertical upper positioning plate 410 to engage a threaded hole 31 in the vertical wall 3 of the machine bed, thereby fixing the upper positioning plate 410 on the machine bed. When the upper lock bolt 414 is disengaged from the threaded hole 31 in the machine bed, the upper lock bolt 414 can move in the upper slide slot 412 in the upper positioning plate 410 to vary the position of the vertical upper positioning plate 410 relative to the machine bed.

The vertical lower positioning plate 411 has a straight lower slide slot 411A formed therethrough. A horizontal base connecting plate 411B extends integrally from the vertical lower positioning plate 411, and has a threaded hole 411D (see FIG. 6) formed therethrough. A lower lock bolt 411C extends through the lower slide slot 411A in the lower positioning plate 411 to engage a threaded hole 41A in the base 41, thereby fixing the lower positioning plate 411 on the base 41. When the lower lock bolt 411C is disengaged from the threaded hole 41A in the base 41, the lower lock bolt 411C can move in the lower slide slot 411A to vary the position of the lower positioning plate 411 relative to the base 41.

Figure 6:
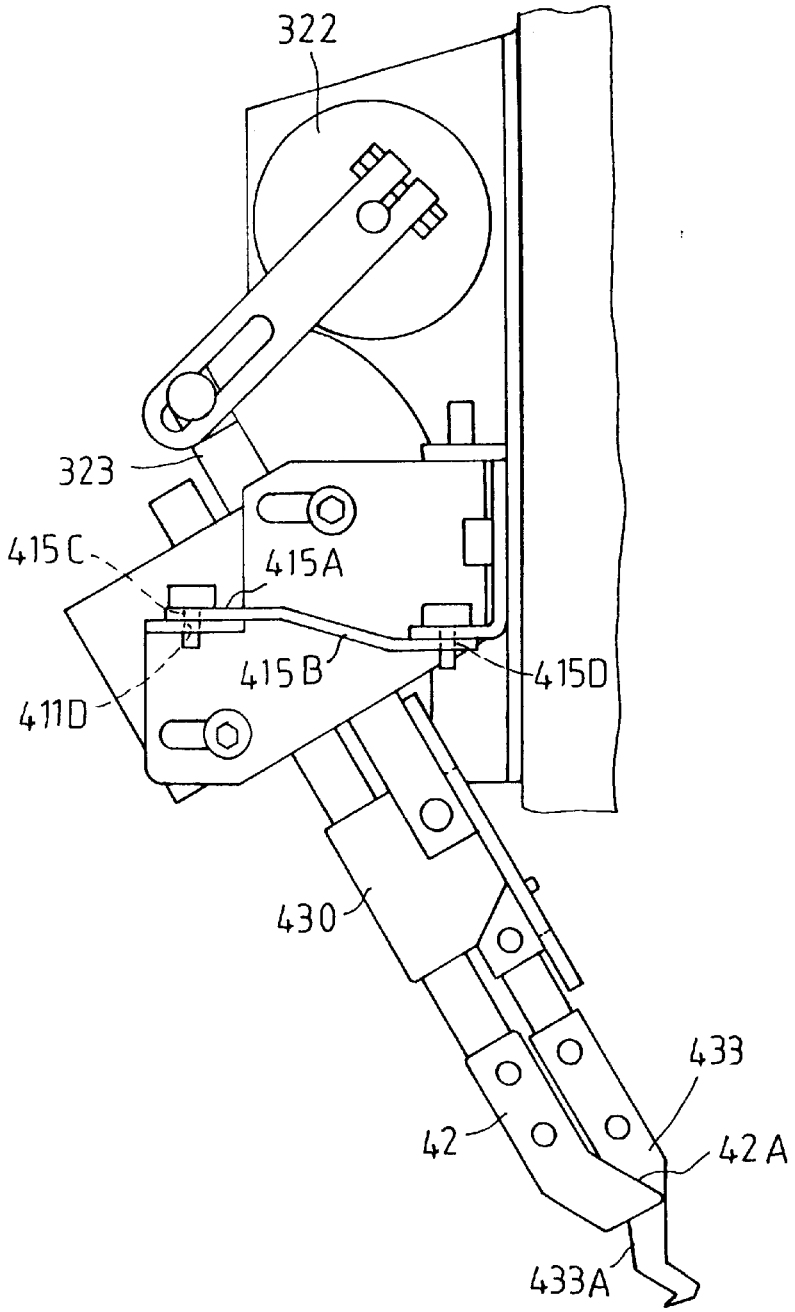
FIG. 6 illustrates the movement of a second blade member relative to a first blade member of the preferred embodiment.

The zigzag-cross-sectioned connecting plate 415 has two parallel plate sections 415A, 415B (see FIG. 6), which are formed respectively with a circular hole 415C and a threaded hole 415D (see FIG. 6). An intermediate lock bolt 410B extends through the intermediate slide slot 413 in the machine-bed connecting plate 410A to engage the threaded hole 415D in the zigzag-cross-sectioned connecting plate 415. A vertical lock bolt 415E (see FIG. 3) extends through the circular hole 415C in the zigzag-cross-sectioned connecting plate 415 to engage the threaded hole 411D (see FIG. 6) in the lower positioning plate 411. Accordingly, the orientation of the base 41 relative to the vertical wall 3 of the machine bed can be adjusted.

A guiding member 416 is fixed on the base 41, and has a guide slot 417 (see FIG. 5) with two closed ends. The sliding member 430 is provided with an integral projecting rod 435 (see FIG. 5), which extends slidably into the guide slot 416 in the guiding member 430.

In operation, when the motor 322 is started, the second blade member 433 can move relative to the first blade member 42 between the positions shown in FIGS. 5 and 6.

With this invention thus explained, it is apparent that numerous modifications and variations can be made without departing from the spirit and scope of this invention. It is therefore intended that this invention be limited only as indicated in the appended claims.

I claim:

1. A scissors-type thread-cutting device for a sewing machine, the machine including a machine bed, which has a vertical wall that is formed with a threaded hole, the thread-cutting device comprising:

an elongated base adapted to be fixed on the vertical wall of the machine bed;

an elongated first blade member mounted telescopically on said base and movable lengthwise on said base;

means for locking said first blade member releasably on said base;

a sliding member mounted slidably on said first blade member and movable lengthwise on said first blade member;

a driving unit adapted to be disposed on the vertical wall of the machine bed for activating said sliding member to reciprocate on said first blade member;

an elongated second blade member mounted telescopically on said sliding member and pressing against said first blade member, said second blade member being capable of moving lengthwise on said sliding member, said first and second blade members having intersecting cutting edges, which are adapted to cut a thread therebetween during movement of said second blade member relative to said first blade member; and means for locking said second blade member releasably on said sliding member;

whereby, the thread can be moved into a space between said first and second blade members, thereby permitting the thread to be cut off by said intersecting cutting edges of said first and second blade members.

2. A scissors-type thread-cutting device as claimed in claim 1, further comprising means for positioning said base on the vertical wall of the machine bed, said base having a vertical side surface formed with a threaded hole, said means for positioning said base on the vertical wall of the machine bed including:

a vertical lower positioning plate having a straight lower slide slot formed therethough;

a horizontal base connecting plate extending integrally and perpendicularly from said vertical lower positioning plate;

a lower lock bolt extending through said lower slide slot in said vertical lower positioning plate to engage said threaded hole in said base, thereby fixing said vertical lower positioning plate on said base, said lower lock bolt being capable of being loosened from said vertical lower positioning plate so as to slide in said lower slide slot in said vertical lower positioning plate, thereby varying position of said vertical lower positioning plate relative to said base;

a vertical upper positioning plate perpendicular to said vertical lower positioning plate and having a straight upper slide slot formed therethrough;

a horizontal machine-bed connecting plate extending integrally and perpendicularly from said vertical upper positioning plate and having a straight intermediate slide slot that extends in a direction parallel to said upper slide slot in said vertical upper positioning plate;

an upper lock bolt extending through said upper slide slot in said vertical upper positioning plate and adapted to engage said threaded hole in the vertical wall of the machine bed, thereby fixing said vertical upper positioning plate on the vertical wall of machine bed, said upper lock bolt being capable of being loosened from said vertical upper positioning plate so as to slide in said upper slide slot in said vertical upper positioning plate, thereby varying position of said vertical upper positioning plate relative to the vertical wall of the machine bed;

a zigzag-cross-sectioned connecting plate having two parallel plate sections, one of said plate sections being bolted to said base connecting plate, the other one of said plate sections having a threaded hole formed therein; and an intermediate lock bolt extending through said intermediate slide slot in said machine-bed connecting plate to engage said threaded hole in said zigzag-cross-sectioned connecting plate;

whereby, orientation of said base relative to the vertical wall of the machine bed can be adjusted.

3. A scissors-type thread-cutting device as claimed in claim 1, wherein said base has a guide slot, which is formed therein and which has two closed ends, said sliding member having an integral projecting rod, which extends slidably into said guide slot in said base.

4. A scissors-type thread-cutting device as claimed in claim 1, wherein said driving unit includes:

a crank having a pivot end portion which is adapted to be mounted pivotally on the vertical wall of the machine bed, and a connecting end portion formed with a slide slot;

a motor adapted to activate said crank to swing on the machine bed; and a coupler having a first end portion connected pivotally to said sliding member, and a second end portion, which is provided with a fixed pivot pin that extends slidably into said slide slot in said crank.

* * * * *